US005460228A

United States Patent [19]

Butler

[11] Patent Number: 5,460,228

[45] Date of Patent: Oct. 24, 1995

[54] FIRE EXTINGUISHER WITH RECORDED MESSAGE

[76] Inventor: Marty Butler, 47 Walbridge Rd., W. Hartford, Conn. 06119

[21] Appl. No.: 93,730

[22] Filed: Jul. 20, 1993

[51] Int. Cl.[6] ..... A62C 13/76

[52] U.S. Cl. ..... 169/30; 340/384.5; 340/568; 340/689; 340/692; 434/226

[58] Field of Search ..... 434/226; 340/568, 340/571, 572, 689, 692, 384.1, 384.5, 384.7; 169/23, 30, 51, 71–89

[56] References Cited

U.S. PATENT DOCUMENTS

| | | | |
|---|---|---|---|
| 2,683,260 | 7/1954 | Lavelle | 340/568 |
| 3,145,375 | 8/1964 | Webb | 340/568 |
| 3,582,949 | 6/1971 | Forst | 340/502 |
| 3,668,648 | 6/1972 | Yoshikawa | 395/275 |
| 3,794,765 | 2/1974 | Goodwater | 381/77 |
| 3,858,195 | 12/1974 | Gregg, Jr. et al. | 360/12 |
| 4,303,395 | 12/1981 | Bower | 434/226 |
| 4,351,999 | 9/1982 | Nagamoto et al. | 340/692 X |
| 4,418,336 | 11/1983 | Taylor | 340/571 |
| 4,575,713 | 3/1986 | Piper | 340/689 X |
| 4,884,067 | 11/1989 | Nordholm et al. | 340/689 X |
| 5,054,585 | 10/1991 | Amano | 187/124 |
| 5,176,858 | 1/1993 | Tsukabe et al. | 264/40.1 |

*Primary Examiner*—Andrew C. Pike
*Attorney, Agent, or Firm*—Howard L. Rose

[57] ABSTRACT

A fire extinguisher is provided with a voice synthesizer attached thereto that is activated by a position sensitive switch such that upon the fire extinguisher being tilted the voice synthesizer broadcasts instructions on use of the fire extinguisher. The voice synthesizer may be activated in response to other situation sensitive sensors to produce messages appropriate to the situation sensed.

7 Claims, 2 Drawing Sheets

FIRE EXTINGUISHER WITH RECORDED MESSAGE

FIELD OF THE INVENTION

The present invention relates to fire extinguishers and more particularly to a fire extinguisher or other controllers of hazardous conditions having recorded instructions on its use incorporated therein.

BACKGROUND OF THE INVENTION

Upon the occurrence of a fire, people are, generally untrained and totally lacking in knowledge regarding the proper use of a fire extinguisher or they can be partially knowledgeable of its proper use or reasonably knowledgeable of its proper use. Even if reasonably knowledgeable, people can be sufficiently disconcerted and forget how to use or fumble badly in the use of a fire extinguisher and at times to such an extent as to render the device substantially useless.

In an attempt to overcome these problems, recorded instructions on proper use of the extinguisher have been provided. An example of such is provided by U.S. Pat. No. 4,303,395. This patent discloses a support rack or bracket for hanging up the extinguisher and connected to the support rack are tape recorded instructions on the use of the extinguisher. When the extinguisher is lifted off of the rack, the message is played. Thus, the user must stand at the hang-up location until the recording is finished, delaying movement toward a fire remote from the hang-up location. Not only is the user's reaction time delayed from the outset but they are forced to remember a series of important implementation instructions, under generally stress filled circumstances, throughout the period they are transporting the extinguisher from the hanger support to the fire and then must recall from memory the precise instructions and implement them in initiating the use of the extinguisher.

There are several problems with such an apparatus. As was mentioned, the recording is not necessarily available at the location of the fire where the greatest danger and confusion reside. Further, if the fire is immediately adjacent the extinguisher rack, danger exists that the tape will be destroyed. A tape subjected to about 100° to 110° F., even for a short period of time, will most probably be damaged. Most certainly, it will lose its magnetism and consequently its recorded instructions.

In addition to the above, the fire extinguisher of the reference must be hung on a support bracket that has been specifically redesigned to turn on a switch controlling the recorder. Thus, a universal hanger bracket cannot be employed. Also, such a device is totally unusable for the multitude of extinguishers not mounted on hanger racks or brackets such as free standing extinguishers resting or standing unsupported on floors, shelves, within cabinets, on stairways, and the like.

BRIEF DESCRIPTION OF THE PRESENT INVENTION

The present invention provides a device either strapped onto or built into a fire extinguisher that upon activation provides voice instructions on operation of the extinguisher. The device may be activated manually, by a position sensitive switch, by a touch sensitive switch, remote broadcast of a signal to a switch that effects the turning on or off of the switch or most any commonly available switch, mechanism on the market deemed to be feasible for its operation under varying circumstances.

The recording is produced as synthesized speech by well-known techniques and the chip may be, for instance, Series CT569xx of The Chip Design Technology Inc. The use of a voice synthesis chip has many advantages and is responsible for being able to produce a marketable device as opposed to the prior art. The chip is quite small and is activated at very low energy levels. The only large element of the voice producing device is the speaker or transducer, although the speaker or transducer can be as little as one inch in diameter. As for the batteries, they may be standard alkaline or miniature lithium button cell batteries. Long life non-rechargeable batteries may also be used with a test button much as in battery operated smoke detectors.

The other major advantage of the use of a voice synthesizing chip is the enhanced tolerance to heat. As is well known, chips can withstand temperatures up to 140° F. as opposed to 100°–110° F. for cassette or magnetic tapes. A man, preferably, but not necessarily, with gloves, can hold a device at 110° F. or somewhat above. Thus, the chip will still deliver its message at temperatures that a man can tolerate but a cassette or magnetic tape cannot.

Another major advantage of the use of a voice synthesis chip is size. Because of its compact miniature size, it is easily transportable and thus allows the instructing device to travel with the extinguisher whenever and wherever such extinguisher is needed most.

The use of a voice synthesis chip adds the full advantage of total reliability so desperately needed during emergencies. Chips have no moving parts and no need for maintenance generally associated with devices using moving parts-like tape recorders.

The design of the present device is intended to allow ready adaptation to more advanced technologies now in development such as fuzzy logic chips and diamond chips that operate at temperatures as high as 700° C. A combination of fuzzy logic with diamond transistors greatly extends the utility of the present invention. Heat is not the only problem with tapes or cassettes; they cannot perform at low temperatures such as in freezers, cold storage areas, and the like while chips are virtually unaffected as are some batteries such as lithium batteries that operate as low as –40° F.

The concepts of the present invention extend to messages instructing the user in the proper responses to variations in the fire or other hazardous events. One very significant message for instance would be a message to leave the premises because the fire is growing in intensity (heat) at too rapid a rate. Other messages could, for instance, locate the hot spot and tell the user to move the nozzle of the extinguisher up or down or sideways, etc.

OBJECTS OF THE INVENTION

It is an object of the present invention to provide a fire extinguisher having secured to it, or incorporated in it, a speech producing mechanism for providing instructions on its use that can withstand temperatures above those that can normally be tolerated by a human.

Still another primary object of the present invention is to use a voice synthesizing chip.

Yet, another object of the present invention is to provide a device for use in situations involving hazardous conditions which device can operate over extended ranges of temperature from well below freezing to well above 100° F.

It is still another object of the present invention to provide a device that uses no moving parts for producing audible instructions on the use of a further device with which it is associated.

It is another object of the present invention to provide a wholly self-contained portable fire extinguisher with operating instructions and warning signals.

It is yet another object of the present invention to provide a fire extinguisher with a self-contained voice generator that responds to various ambient conditions to provide different messages providing a suitable response to variations in such conditions.

It is another object of the present invention to provide a fire extinguisher with a mechanism for producing audible instructions on its use which mechanism is activated by a position sensitive switch, a touch switch, or a remote broadcast of a signal that affects the turning on and off of the device generating circuitry.

Yet, another object of the present invention is to incorporate in or attach to a fire extinguisher a mechanism for providing audible instructions on the use of the mechanism which mechanism can be activated by a manual switch, used primarily for training and test purposes.

It is another object of the present invention to provide a fire extinguisher with voice instruction that does not require a special hanger or modification of existing hangers or brackets and that also requires no support mechanism whatsoever in order to be operable.

It is still another object of the present invention to provide a fire extinguisher with a verbal instruction integrated circuit chip, thus eliminating failure of operating mechanisms such as motor drives, reels, tape cassettes, and the like and associated maintenance procedures.

It is still another object of the present invention to provide a fire extinguisher with a verbal instruction device that will be portable with the extinguisher providing instructions from inception of the fire emergency, through transport of the extinguisher, to use of the extinguisher to contain the fire whenever and wherever the fire remotely occurs from where the extinguisher is housed at the inception of the emergency.

It is still another object of the present invention to allow the user in a fire emergency greater time to get to and begin fighting a fire by eliminating the need to stand and wait for instructions to be heard or the user to have to read instructions.

DETAILED DESCRIPTION OF THE PRESENT INVENTION

Figure 1:
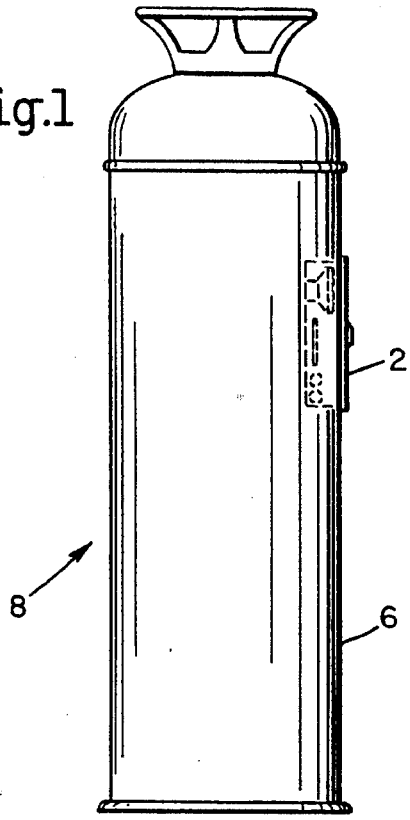
FIG. 1 illustrates a fire extinguisher with a built in recorded message device.
Figure 2:
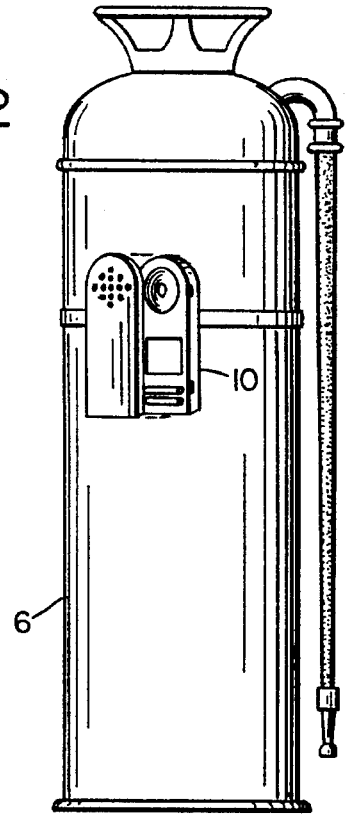
FIG. 2 illustrates a fire extinguisher with a recorded message device strapped on the extinguisher.
Figure 3:
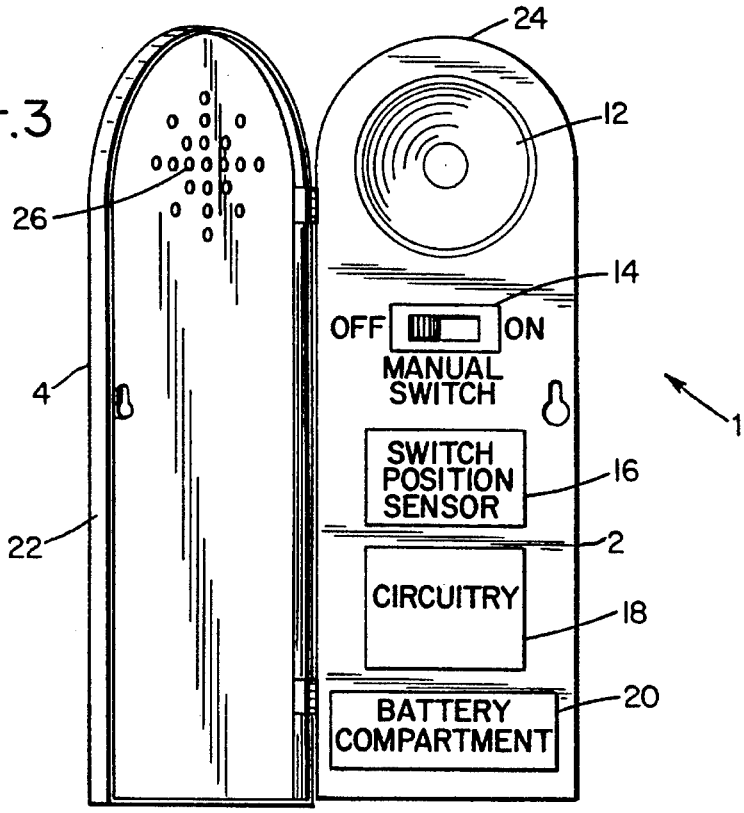
FIG. 3 illustrates one possible arrangement of components of the recorded message device in its container.

Referring now specifically to FIGS. 1–3 of the accompanying drawings, there are illustrated the details of the present invention in two embodiments.

In FIG. 1, the announcing device 1 (see also FIG. 3) is disposed in a shell 2 with a hinged cover 4, the shell being integral with or embedded in the canister 6 of fire extinguisher 8.

In FIG. 2, the announcing device is a separate unit, reference numeral 10 in FIG. 2, strapped onto the extinguisher canister 6.

The announcing device 1 includes (see FIG. 3) a speaker, transducer, or audible output means 12, a manual switch 14, a position sensitive switch 16, a circuit and associated electronics 18, and a battery compartment 20. The device 1 has a cover 22 hinged or otherwise securable to main body 24 of the device 1 and has an opening 26 located so that the speaker or transducer or audible instruction means has direct communication with the surrounding air. The cover 22 and main body 24 have latching means (not illustrated) to retain the cover in a closed position.

Figure 4:
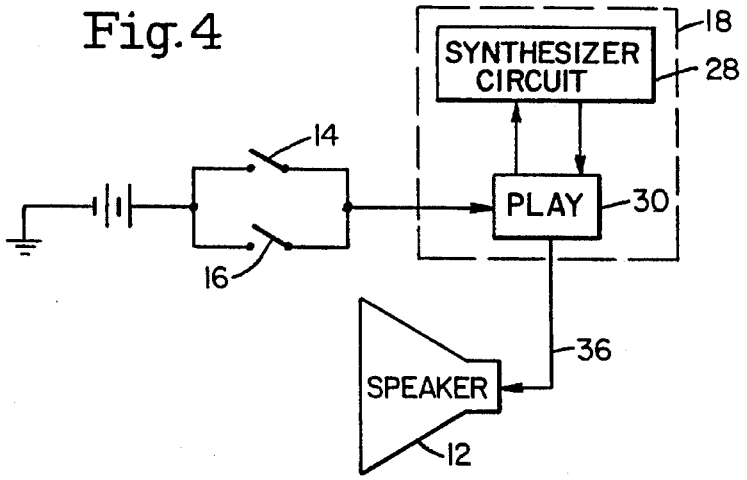
FIG. 4 is a block diagram of the recorded message device of the present invention.

Referring now to FIG. 4 of the accompanying drawings, there is illustrated a block diagram of the electronics employed in the present invention. The electronics consists of a speech synthesizer 28 and a play control 30. When one of switches 14 and 16 is closed, the play control circuit 30 energizes, via lead 32, the synthesizer 28 which passes the signals via lead 34, play circuit 30, and lead 36 to speaker 12. Once the message has been sent, it may shut off and remains off until the ball switch is opened and tilted again. Other types of operation are discussed subsequently.

Figure 5:
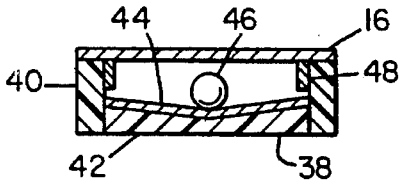
FIG. 5 is a cross-sectional view of a ball switch that may be used to activate the recorded message synthesizer.

Referring now specifically to FIG. 5 of the accompanying drawings, there is illustrated a preferred embodiment of a position sensitive switch 16 of the present invention. The switch 16 is a ball switch consisting of a closed, hollow, non-conductive cylinder 38 having a circular side wall 40, and a bottom end wall 42 that internally slopes downward from the side wall 40 to its center. The floor is covered with a conductive coating or layer 44 and a conductive, probably metallic ball 46 rests on the floor. The wall 40 has a conductive coating or layer 48 that does not extend to the floor and thus the coating on the wall and floor are not in electrical contact.

The switch 16 is included within the housing 1 and the ball is positioned as shown in FIG. 5 when the fire extinguisher canister is upright. When the canister is tilted, the ball rolls into contact with the sidewall and completes the circuit. The slope of the floor 42 is shallow so that relatively little tilting is required to start the message.

The type of position sensitive switch is not critical and can be one of any number of ball switches, spring switches, motion detector switches, or alternatively, a contact switch which sends a signal when touched, a remote broadcast of a signal that effects the turning on or off of the switch, or most any commonly available switch mechanisms on the market deemed to be feasible for its operation under varying circumstances. The message may be transmitted only once or it may be continually transmitted depending on the switch mechanism. Regarding fuzzy logic, if the device is not being operated properly then a specific portion of the overall message may be repeated over and over until proper operation of that procedure is achieved. For instance, fire extinguishers operate best when vertical. A position sensor such as the ball switch of FIG. 5 may not only start the instruction message but may also cause a message to be repeated to the effect that the device is to be held in the vertical position if it is not being so held. The message may be repeated until the unit is in the vertical position. Preferably, a second switch having a greater slope may be used for this purpose so that the first switch starts the instruction for use of the device while the switch with the deeper slope can trigger the "hold the extinguisher upright" message that is repeated until the instruction is obeyed. Further using fuzzy logic and a sensor adjacent the end of the nozzle, a message can be repeated to the effect that the nozzle should be directed to the base of the fire. A similar sensor on the nozzle or canister may sense the distance between the extinguisher and the fire and cause the device to instruct the user to move back a certain distance or move closer a certain distance. By using sensors sensitive to different environmental or like conditions, different messages can be transmitted. Each input from a different sensor can produce a different message which may or may not be repeated as determined by the logic in the speech storage circuit associated with each sensor.

Figure 6:
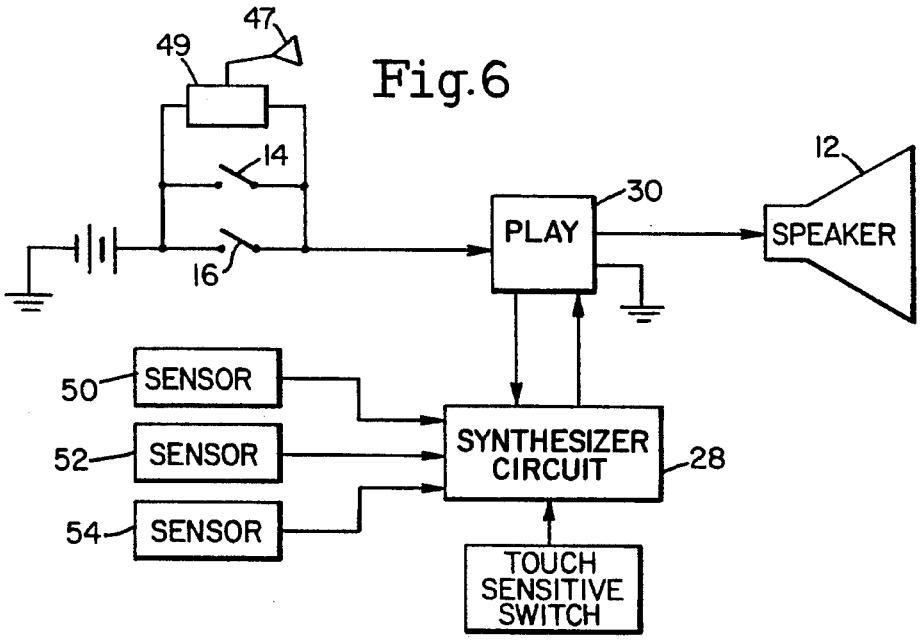
FIG. 6 is a circuit diagram of a device in which different synthesized messages are played depending upon which one of a plurality of sensors is activated.

Referring to FIG. 6, the circuit diagram for a system as stated above would have the same arrangement as in FIG. 4 plus inputs to the synthesizer circuit from various sensors. FIG. 6 uses the same reference numerals as FIG. 4 for the same elements. A microphone pickup 47 may be added to activate a switch 49 upon receipt of a remote message so the instructions can be started as the user approaches the device. In addition, the circuit may be provided with, for instance, three sensors, 50, 52, and 54. Sensor 50 may be a heat sensor and have a synthesizer message telling the operator to direct the stream to the base of the fire (fuzzy logic is particularly useful here), the sensor 52 can be the vertical position sensor, and the sensor 54 can be used to determine the effectiveness of the extinguisher, for instance is the fire increasing in intensity at a rate that it is out of control, that is "get out!" or "leave premises now". A simple rate of change circuit would serve this function—an integrator and a clock to define integration periods. Another sensor could be added or substitute for one of those just described in FIG. 6 that would determine the distance from the extinguisher to the fire and instruct the user to move closer so many feet or move back so many feet.

As in any synthesizing circuit, the signal is applied in a well-known way to the synthesizer which causes the message to be reproduced. Various messages may be reproduced depending upon the sensor activated. An example of a speech synthesizer with multiple message capability is disclosed in U.S. Pat. No. 4,375,329, the disclosure of which is incorporated herein by reference, see also U.S. Pat. No. 4,369,334. Speech synthesizer chips are available from many sources, one such source being Chip Design Technology, Inc., Series CT569xx. Touch sensitive switches are available from Bright Image Corporation of Hillside, Ill., as well as many others. A discussion of fuzzy logic is found in the book *Fuzzy Logic* by McNeill and Freiberger, Simon and Schuster, 1993; see particularly pages 10 to 13, 105, and 161–173. Also refer to the book *Fuzzy Thinking* by Bart Kosko, Hyperion, 1993.

Other improvements, modifications and embodiments will become apparent to one of ordinary skill in the art upon review of this disclosure. Such improvements, modifications and embodiments are considered to be within the scope of this invention as defined by the following claims.

What is claimed is:

1. A combination of a portable fire extinguisher and a device having a voice synthesizer chip for generating verbal instructions on use of said fire extinguisher, said combination further comprising:

means for associating said device with said fire extinguisher so that said device is portable with said fire extinguisher, a position sensitive switch for sensing vertical alignment of said fire extinguisher, and means responsive to said position sensitive switch for activating said voice synthesizer chip to generate the verbal instructions.

2. The combination according to claim 1 wherein said position sensitive switch is a ball switch.

3. The combination according to claim 1 further comprising a touch sensitive switching means for activating said voice synthesizer chip.

4. The combination according to claim 1 further comprising a heat sensitive sensor for activating said voice synthesizer chip.

5. The combination according to claim 1 further comprising means for sensing a rate of change of temperature of a fire, said device being responsive to the rate of change of the temperature being above a prescribed rate to activate said device to produce a warning signal.

6. The combination according to claim 1 further comprising a plurality of condition sensors, and means for activating said voice synthesizer chip responsive to each of said sensors to produce a different verbal message.

7. The combination according to claim 1 further comprising a plurality of condition sensors, means for activating said voice synthesizer chip responsive to each of said sensors to produce a different verbal message, said sensors including means for determining distance of said fire extinguisher from a fire, and means for producing a signal indicating need to change the distance from the fire.

* * * * *